US008807603B2

(12) United States Patent
Niwa et al.

(10) Patent No.: US 8,807,603 B2
(45) Date of Patent: Aug. 19, 2014

(54) LID LOCK APPARATUS

(75) Inventors: Takumi Niwa, Kariya (JP); Toshihiro Kitamura, Okazaki (JP)

(73) Assignee: Aisin Seiki Kabushiki Kaisha, Kariya-Shi, Aichi-Ken (JP)

( * ) Notice: Subject to any disclaimer, the term of this patent is extended or adjusted under 35 U.S.C. 154(b) by 169 days.

(21) Appl. No.: 13/427,433

(22) Filed: Mar. 22, 2012

(65) Prior Publication Data

US 2012/0242095 A1 Sep. 27, 2012

(30) Foreign Application Priority Data

Mar. 23, 2011 (JP) ..... 2011-063983

(51) Int. Cl.
*E05C 1/02* (2006.01)

(52) U.S. Cl.
USPC ..... 292/142

(58) Field of Classification Search
CPC ..... E05B 81/06; E05B 85/26; E05B 81/14
USPC ..... 292/201, 216, DIG. 23, 142, 80, 81, 87, 292/89, DIG. 38, DIG. 53
See application file for complete search history.

(56) References Cited

U.S. PATENT DOCUMENTS 3,786,864 A 1/1974 Segelhorst
4,996,028 A 2/1991 Danielsen et al.
5,125,457 A 6/1992 Meaders
5,222,774 A * 6/1993 Fukumoto et al. ..... 292/144
5,582,448 A * 12/1996 Inoue ..... 292/336.3
5,632,515 A * 5/1997 Dowling ..... 292/216
5,673,578 A * 10/1997 Roos ..... 70/264
6,223,468 B1 * 5/2001 Kobayashi ..... 49/280

(Continued)

FOREIGN PATENT DOCUMENTS

EP 2 182 147 A2 5/2010
EP 2 182 148 A2 5/2010

(Continued)

OTHER PUBLICATIONS

Baker Hughes Incorporated, "BCCI-1 Tubing Retrievable Chmeical Injection Valve", Advancing Reservoir Performance, Baker Oil Tools, p. 1.

(Continued)

*Primary Examiner* — Carlos Lugo
*Assistant Examiner* — Nathan Cumar
(74) *Attorney, Agent, or Firm* — Buchanan Ingersoll & Rooney PC

(57) ABSTRACT

A lid lock apparatus includes a housing formed by assembling a first body member and a second body member, a driving motor housed in the housing, an output gear, a movable member, a stopper member retained at one of the first body member and the output gear, a stopper wall formed at the other one of the first body member and the output gear and restricting the pivotal movement of the output gear by contacting the stopper member, and a stopper disengagement preventing portion formed on the other one of the first body member and the output gear, on which the stopper wall is formed, the stopper disengagement preventing portion restricting a disengagement of the stopper member in an axial direction of a rotational axis of the output gear by contacting the stopper member in the axial direction of the rotational axis of the output gear.

18 Claims, 6 Drawing Sheets

(56) References Cited

U.S. PATENT DOCUMENTS

| | | | | |
|---|---|---|---|---|
| 6,422,616 | B1 * | 7/2002 | Wortmann et al. | 292/216 |
| 6,666,271 | B2 | 12/2003 | Deaton et al. | |
| 7,070,018 | B2 * | 7/2006 | Kachouh | 180/287 |
| 7,213,653 | B2 | 5/2007 | Vick, Jr. | |
| 2001/0005079 | A1 * | 6/2001 | Takamura | 292/201 |
| 2001/0033082 | A1 * | 10/2001 | Hayakawa et al. | 292/216 |
| 2002/0117863 | A1 * | 8/2002 | Shinkawa | 292/216 |
| 2004/0000407 | A1 | 1/2004 | Hernandez et al. | |
| 2009/0032238 | A1 | 2/2009 | Rogers et al. | |
| 2009/0071654 | A1 | 3/2009 | O'Malley et al. | |
| 2011/0115239 | A1 | 5/2011 | Imatomi et al. | |

FOREIGN PATENT DOCUMENTS

| | | | |
|---|---|---|---|
| JP | 4-302680 | A | 10/1992 |
| JP | 6-71815 | U | 10/1994 |
| JP | 2001-107617 | A | 4/2001 |
| JP | 2009-127288 | A | 6/2009 |
| JP | 2010-106438 | A | 5/2010 |
| JP | 2010-177109 | A | 8/2010 |

OTHER PUBLICATIONS

G. Salerno, Baker Hughes Incoproated, The Evolution of Advanced Well Completions Results in Enhanced Well Productivity and Recovery in Saudi Aramco's Offshore Fields, SPE 103621, IADC/SPE Asia Pacific Drilling Technology Conference and Exhibition, Nov. 13-15, 2006.

* cited by examiner

LID LOCK APPARATUS

CROSS REFERENCE TO RELATED APPLICATIONS

This application is based on and claims priority under 35 U.S.C. §119 to Japanese Patent Application 2011-063983, filed on Mar. 23, 2011, the entire content of which is incorporated herein by reference.

TECHNICAL FIELD

This disclosure generally relates to a lid lock apparatus.

BACKGROUND DISCUSSION

A known lid lock apparatus for retaining a lid member (fuel filler door) which opens and closes a fuel filler lid box which accommodates a fuel filler opening at a closed state is, for example, disclosed in JPH04-302680A (i.e., hereinafter referred to as Patent reference 1). The lid lock apparatus which is mounted to a vehicle body constantly biases a shaft member by a spring and engages a tip end of the shaft member protruding from a housing to the lid member (i.e., a locked position). When refueling, the shaft member is retracted by means of a worm wheel actuated by an electric motor to disengage the shaft member from the lid member (i.e., an unlocked state).

According to the known lid lock apparatus disclosed in the Patent reference 1, a retaining portion shaped in a circular column protrudes from a bottom surface portion of the housing, and a cylindrical stopper member which is made from an elastic member, for example, synthetic resin, is outfitted to the retaining portion. By a contact of a stopper wall provided at a bottom surface of the worm wheel to the stopper member, a rotation of the worm wheel is stopped, thus restricting a movement of the shaft member. The stopper member applied in the known lid lock apparatus disclosed in the Patent reference 1 is simply outfitted to the retaining portion in a press-fitted state. According to the foregoing construction, the stopper member is lifted up relative to the retaining portion because of a deflection (flexure) repeatedly generated at the stopper by the contact of the stopper wall provided at the worm wheel to the stopper member, which may cause a drawback that the retaining portion falls out of the retaining portion. Particularly, in a case where the worm wheel is actuated by a helical gear, the stopper member is likely to be disengaged from the retaining member because the force for pulling out the stopper member is applied every time the stopper wall contacts the stopper member.

JP2010-106438A (i.e., hereinafter referred to as Patent reference 2) discloses a known lid lock apparatus, as shown in FIG. 12, which is devised for preventing the disengagement of the stopper member from the retaining portion. A lid lock apparatus 80 includes a housing 800 which is formed by fitting a body 81 and a cover 82, a worm 84 actuated by an electric motor housed in the housing 800, a worm wheel 85 pivotally supported within the housing 800 and being rotatable in one direction and the other direction by an actuation of the worm 84, and a lock shaft 86 supported within the housing 800 to be axially movable and being engaged with and disengaged from the lid member.

Further, the body 81 includes a retaining portion 81*b* protruding from a bottom surface portion 81*a*, and a stopper member 88 is fitted to the retaining portion 81*b*. A stopper disengagement preventing portion 82*b* formed in a circular column shape protrudes from an inner surface 82*a* of the cover 82, and the disengagement of the stopper member 88 from the retaining portion 81*b* is restricted by a contact of the stopper disengagement preventing portion 82*b*, which is provided penetrating though an arc shaped slit 85*a* formed on the worm wheel 85, to an end surface of the stopper member 88.

The worm wheel 85 of the lid lock apparatus 80 disclosed in the Patent reference 2 is formed with the arc shaped slit 85*a* for allowing an insertion of the stopper disengagement preventing portion 82*b*. Thus, there is a drawback that the rigidity of the worm wheel 85 is declined.

A need thus exists for a lid lock apparatus which is not susceptible to the drawback mentioned above.

SUMMARY

In light of the foregoing, the disclosure a lid lock apparatus, which includes a housing formed by assembling a first body member and a second body member, a driving motor housed in the housing, an output gear pivotally supported within the housing and being rotatable in a first direction and a second direction by an actuation of the driving motor, a movable member movably supported in the housing, the movable member moving in one direction by a pivotal movement of the output gear in the first direction to make a lid member provided at a vehicle body be unopenable and moving in the other direction by the pivotal movement of the output gear in the other direction to make the lid member to be openable, a stopper member retained at one of the first body member and the output gear, a stopper wall formed at the other one of the first body member and the output gear and restricting the pivotal movement of the output gear by contacting the stopper member, and a stopper disengagement preventing portion formed on said the other one of the first body member and the output gear, on which the stopper wall is formed, to be close to the stopper wall, the stopper disengagement preventing portion restricting a disengagement of the stopper member in an axial direction of a rotational axis of the output gear by contacting the stopper member in the axial direction of the rotational axis of the output gear.

BRIEF DESCRIPTION OF THE DRAWINGS

The foregoing and additional features and characteristics of this disclosure will become more apparent from the following detailed description considered with the reference to the accompanying drawings, wherein.

DETAILED DESCRIPTION

An embodiment of the lid lock apparatus will be explained with reference to illustrations of drawing figures as follows. A construction of a lid lock apparatus 1 according to the embodiment will be explained referring to FIGS. 1 to 11 as follows. In those circumstances, orientations of the lid rock apparatus is defined as follows: a right hand direction in FIG. 3 is defined as a forward direction of the lid lock apparatus 1, and a left hand direction in FIG. 3 is defined as a rearward direction of the lid lock apparatus 1 unless otherwise specified. Further, an upward direction in FIG. 3 is defined as an upward direction of the lid lock apparatus 1 and a downward direction in FIG. 3 is defined as a downward direction of the lid lock apparatus 1. The lid lock apparatus 1 is provided at a vehicle body 3 and is configured to engage with a lid member 32 which is for opening and closing a lid box 31 in which a fuel filler opening is accommodated (see FIG. 5) so that the lid member 32 is assumed to be unopenable.

Figure 1:
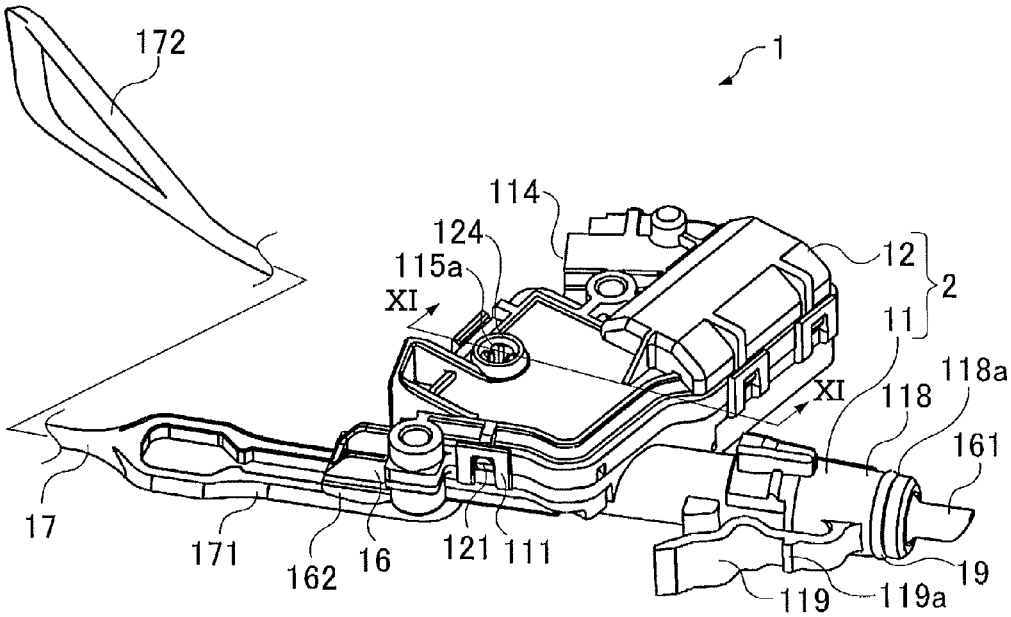
FIG. 1 is a perspective view of a lid lock apparatus according to a first embodiment disclosed here.
Figure 2:
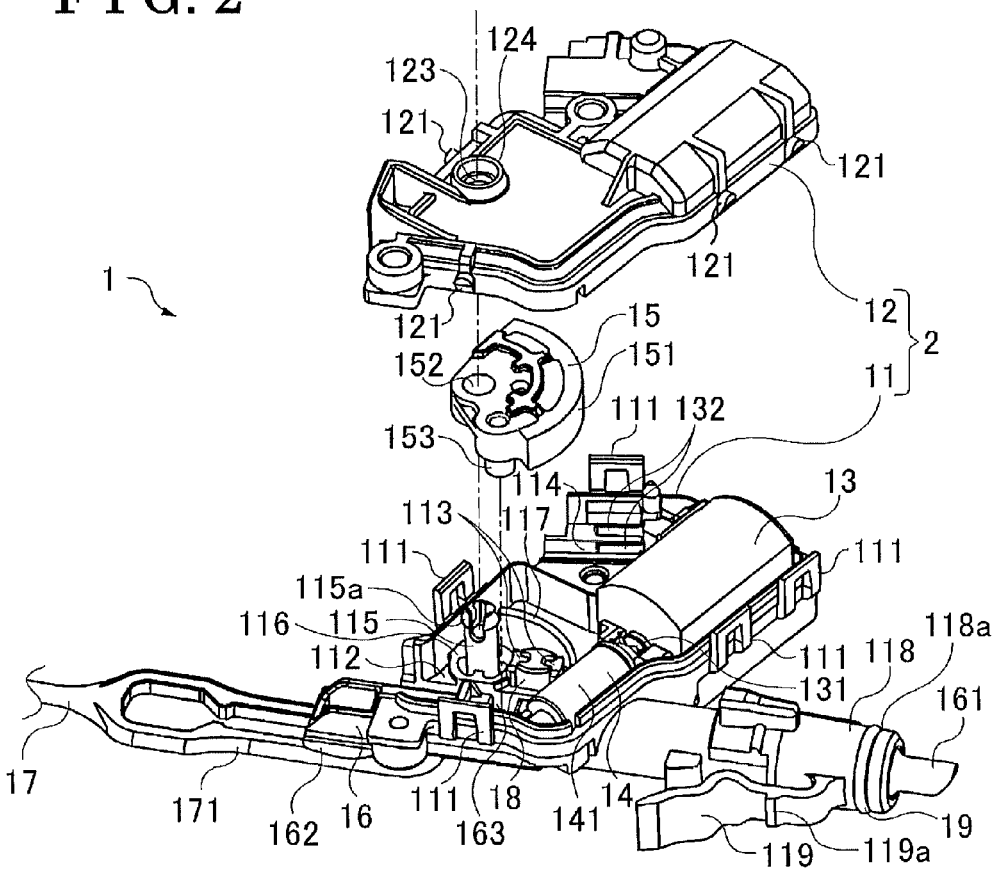
FIG. 2 is an exploded perspective view of the lid lock apparatus disclosed in FIG. 1 according to the first embodiment disclosed here.
Figure 3:
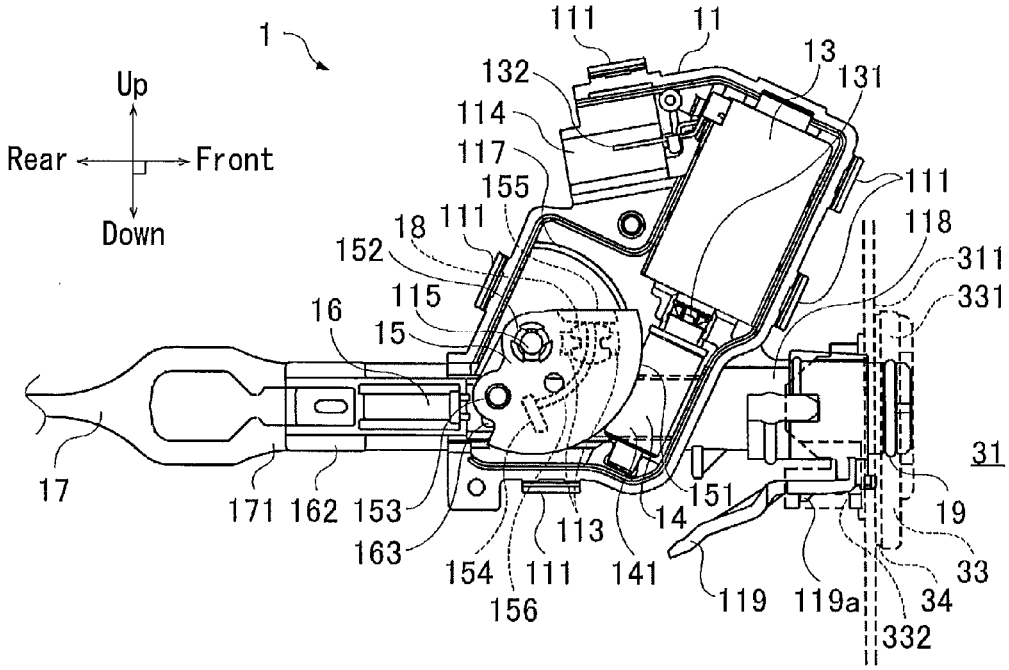
FIG. 3 is a front view of an inside of the lid lock apparatus shown in FIG. 1 without a cover in a state where the lid lock apparatus is positioned at an unlocked state according to the first embodiment disclosed here.

As shown in FIGS. 1 and 2, the lid lock apparatus 1 includes an actuator housing (i.e., serving as a housing; hereinafter referred to as the housing) 2 which is formed by a body member (i.e., serving as a first body member) 11 and a cover (i.e., serving as a second body member) 12. The lid lock apparatus 1 further includes an electric motor (i.e., serving as a driving motor) 13, a worm 14, a worm wheel (i.e., serving as an output gear) 15, a lock shaft (i.e., serving as a movable member) 16, and a stopper member 18, which are housed in the housing 2.

The body member 11 and the cover 12 are made from synthetic resin material. The body member 11 and the cover 12 are fitted (assembled) to each other after housing the electric motor 13, the worm 14, the worm wheel 15, the lock shaft 16, and the stopper member 18, and an engaging piece 111 which is formed at an outer periphery of the body member 11 in a shape of a gate is engaged, or latched to an engaging protrusion portion 121 formed on an outer periphery of the cover 12 so that the body member 11 and the cover 12 are integrally connected.

Figure 4:
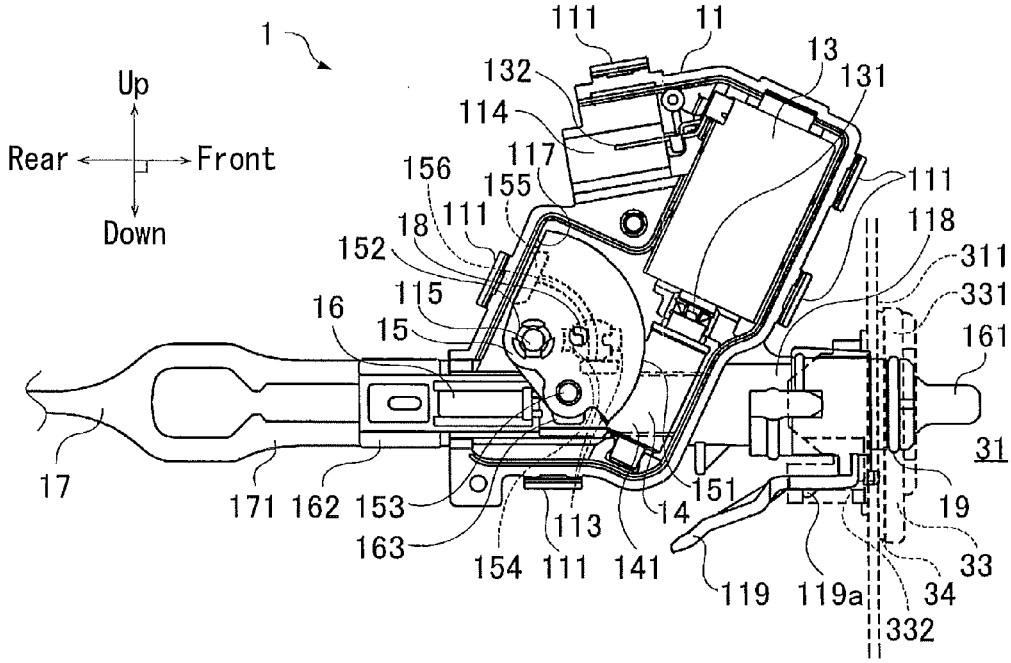
FIG. 4 is a front view of an inside of the lid lock apparatus shown in FIG. 1 without the cover in a state where the lid lock apparatus is positioned at a locked state according to the first embodiment disclosed here.
Figure 5:
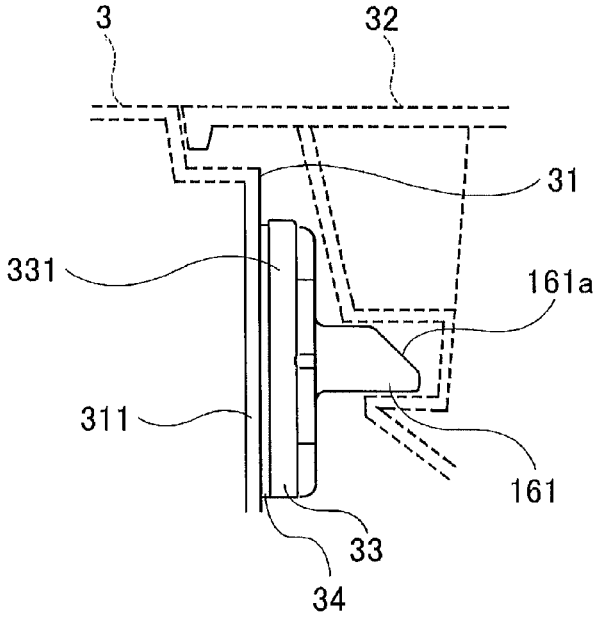
FIG. 5 is a partial view showing an engaging state of a lock shaft and a lid member of the lid lock apparatus shown in FIG. 1 according to the first embodiment disclosed here.
Figure 6:
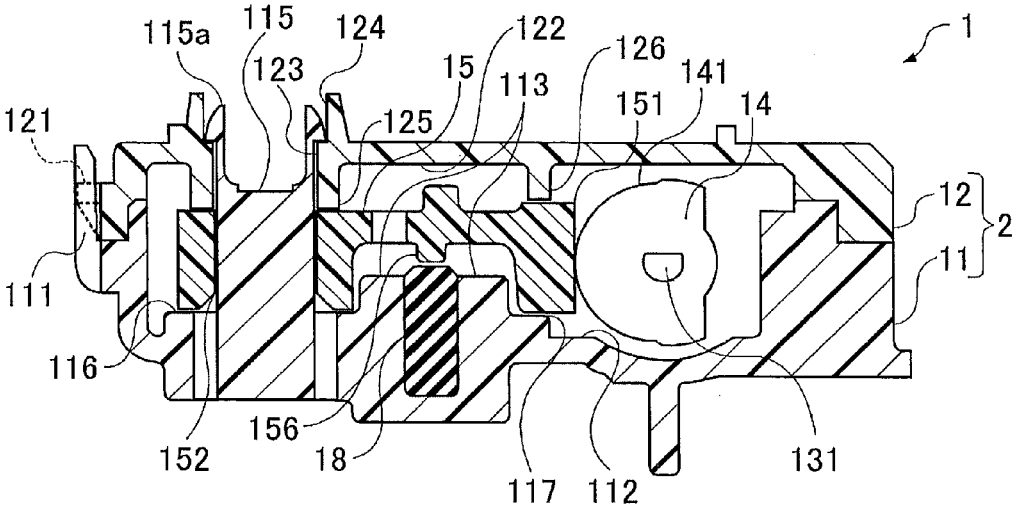
FIG. 6 is a cross-sectional view of the lid lock apparatus shown in FIG. 1 taken on line XI-XI according to the first embodiment disclosed here.

As shown in FIG. 6, a pair of retaining portions 113 which protrudes towards the worm wheel 15 is formed on a bottom portion 112 of the body member 11, and the stopper member 18 is mounted between the pair of retaining portions 113. As shown in FIGS. 2 to 4, the retaining portion 113 is formed in an approximately T-shape in a profile, and each of the retaining portions 113 is positioned keeping a predetermined distance from each other while facing tip ends of T-shaped webs each other. As shown in FIGS. 2 to 6, a shaft member 115 serving as a rotational axis of the worm wheel 15 is arranged on the bottom portion 112 of the body member 11 in an upward-downward direction to extend towards the cover 12. Plural, for example, three hooks 115*a* are formed on a tip end of the shaft member 115.

As shown in FIGS. 2 to 6, an annular first receiving portion 116 which supports a portion of the worm wheel 15 in the vicinity of a pivot hole 152 is formed around the shaft member 115. Further, a second receiving portion 117 which is a rim formed in an arc shape is formed to support a portion of the worm wheel 15 in the vicinity of an outer periphery surface 151 of the worm wheel 15.

Figure 8:
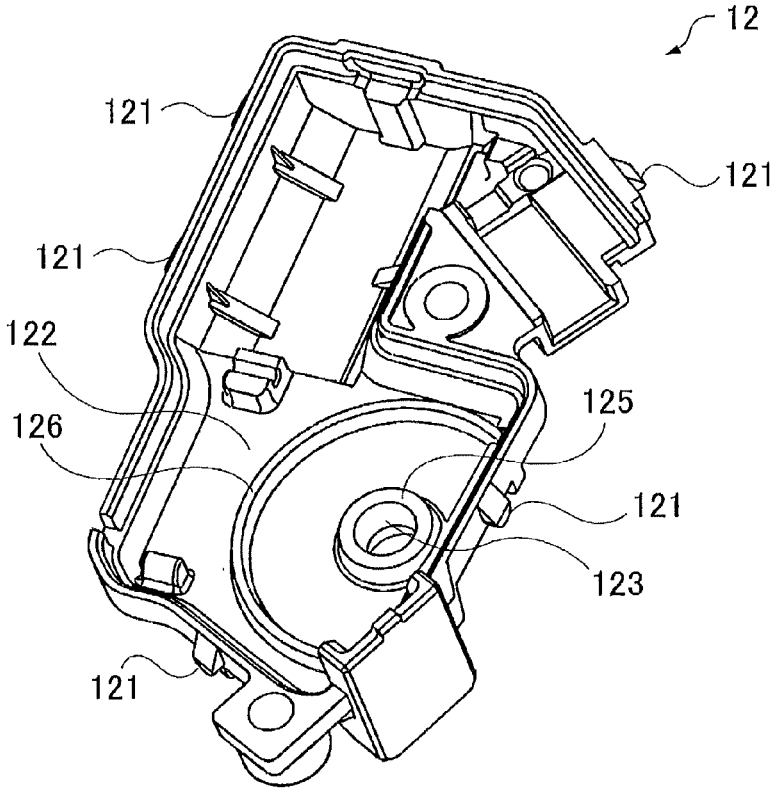
FIG. 8 is a perspective view of an inner side of the cover of the lid lock apparatus shown in FIG. 1 according to the first embodiment disclosed here.

As shown in FIG. 8, the cover 12 is formed with an engagement hole 123 defined by a wall protruding from an inner surface 122 of the cover 12, and the shaft member 115 is inserted through the engagement hole 123. The cover 12 is engaged with the body member 11 by an engagement of the hooks 115*a* of the shaft member 115 to a rim portion of the engagement hole 123 by a snap-fit structure. As shown in FIG. 6, a boss 124 is formed protruding upwardly from an outer surface of the cover 12 surrounding the engagement hole 123. The boss 124 prevents the hooks 115*a* from contacting surrounding components.

As shown in FIGS. 6 and 8, a first output gear disengagement preventing portion 125 and a second output gear disengagement preventing portion 126 configured to contact the worm wheel 15 in an axial direction (a direction of rotational axis) of the worm wheel 15 is formed on the inner surface 122 of the cover 12 to restrict the disengagement of the worm wheel 15 from the shaft member 115. The first output gear disengagement preventing portion 125 is annularly formed around the engagement hole 123. Further, the second output gear disengagement preventing portion 126 is formed as a rib formed in an arc shape at a position which is configured to contact the portion of the worm wheel 15 in the vicinity of the outer peripheral surface 151.

An output shaft 131 of the electric motor 13 is press fitted to the worm 14, and the worm 14 is configured to be rotatable in a first direction and a second direction by an actuation of the electric motor 13. The worm 14 is made of metal or synthetic resin material, and a teeth portion is formed on an outer peripheral surface of the worm 14. After the output shaft 131 of the electric motor 13 is press-fitted to the worm 14 (i.e., after the electric motor 13 and the worm 14 are integrally connected), the electric motor 13 and the worm 14 are provided on the bottom portion 112 of the body member 11. A pair of motor terminals 132 for supplying electric power is connected to the electric motor 13, and the electric power is supplied to the motor terminal 132 via a connector which is positioned in a connector portion 114 of the body member 11.

The worm wheel 15 is made from synthetic resin material and is formed in an approximately sector shape so that the outer peripheral surface 151 is formed in an arc shape. The pivot hole 152 penetrates through surfaces of the worm wheel 15. The worm wheel 15 is provided to be rotatable about the shaft member 115 in a first direction and a second direction relative to the body member 11 by fitting the pivot hole 152 to the shaft member 115 which protrudes from the bottom portion 112 of the body member 11. A teeth portion is formed on an outer periphery surface 151 of the worm wheel 15, and is geared with the teeth portion of the worm 14.

Figure 7:
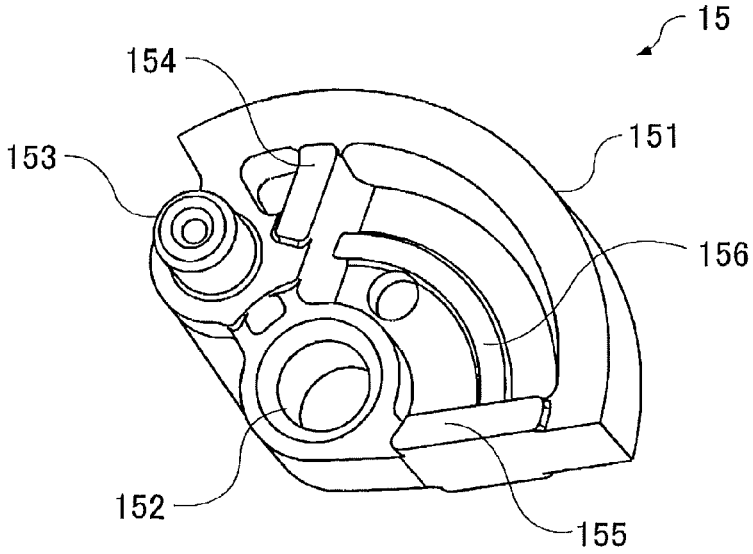
FIG. 7 is a perspective view of a worm wheel of the lid lock apparatus shown in FIG. 1 viewed from a position where a body member is provided according to the first embodiment disclosed here.

The worm wheel 15 includes an engaging column 153 which protrudes downwardly in FIG. 2. As shown in FIGS. 3 and 7, a first stopper wall (i.e., serving as a stopper wall) 154 which includes a flat wall protruding towards the bottom portion 112 of the body member 11 is positioned in the vicinity of the engaging column 153. On the other hand, a second stopper wall (i.e., serving as a stopper wall) 155 which protrudes in the same direction with the first stopper wall 154 (i.e., protruding towards the bottom portion 12 of the body member 11) is positioned in the vicinity of the pivot hole 152. As shown in FIGS. 3 and 4, in response to a rotation of the worm wheel 15, the rotation (pivotal movement) of the worm wheel 15 is restricted by a contact of the stopper member 18 relative to the first stopper wall 154 and the second stopper wall 155.

A stopper disengagement preventing portion 156 which includes a rib formed in an arc shape and having a constant height is provided between the first stopper wall 154 and the second stopper wall 155 which are arranged keeping a predetermined distance from each other in a pivotal (rotational) direction of the worm wheel 15. As shown in FIGS. 3, 4, and 6, the stopper disengagement preventing portion 156 constantly contacts or is constantly positioned close to an end surface of the stopper member 18 during the rotation (pivotal movement) of the worm wheel 15.

The lock shaft 16 made from synthetic resin material is formed in an elongated configuration. A lock portion 161 which is configured to engage with the lid member 32 is formed at a front end of the lock shaft 16. The lock portion 161 is formed in a cylindrical shape and is provided with a tapered (slanted) portion 161*a* is formed at a tip end portion of the lock portion 161 (see FIG. 5). The lock shaft 16 is positioned within a shaft retaining portion 118 of the body member 11 to be axially movable therein.

An interlock hole 163 is formed at an intermediate portion of the lock shaft 16 to penetrate therethrough in a thickness direction of the lock shaft 16. The engaging column 153 formed at the worm wheel 15 is positioned in the interlock hole 163.

The lock shaft 16 having the construction explained above is housed within the housing 2 while engaging with the worm wheel 15 to be movable in an axial direction (i.e., a front-rear direction in FIG. 3). Further, a connection portion 162 is formed at a rear end of the lock shaft 16. An end portion 171 of an emergency pull cord 17 is attached to the connection portion 162. In a case where an operation of the lid lock apparatus 1 fails so that the lock shaft 16 cannot be returned to the unlocked position by means of the electric motor 13, an operator can pull the lock shaft 16 by manually pulling a handle portion 172 of the emergency pull cord 17.

The stopper member 18 is made from synthetic rubber material which is an elastic member which excels in thermal resistance and whether resistance, and a profile of the stopper member 18 is formed approximately in H-shape. For example, EPDM rubber (ethylene propylene diene monomer rubber) or EP rubber (ethylene propylene rubber) may be applied to the stopper member 18. As shown in FIGS. 2 to 4, the stopper member 18 is provided elastically between the retaining portions 113 so that both sides of webs of the substantially H-shape profile of the stopper member 18 are sandwiched between the tip ends of the webs of the T-shape of each of the retaining portions 113. Each flange of the stopper member 18 formed in the substantially H-shape includes a round configuration whose protruding curved surface faces outwardly. The first stopper wall 154 formed on the worm wheel 15 is configured to contact the protruding curved surface of one of the flanges of the H-shape profile of the stopper member 18 and the second stopper wall 155 is configured to contact the protruding curved surface of the other of the flanges of the H-shape profile of the stopper member 18.

After the components forming the lid lock apparatus 1 are housed in the body member 11, the cover 12 is fitted (assembled) to the body member 11. In those circumstances, the engaging piece 11 of the body member 11 is engaged with the engaging protruding portion 121 of the cover 12, and the hook 115*a* of the shaft member 115 of the body member 11 is engaged with the rim portion of the engagement hole 123 of the cover 12 so that the cover 12 is integrally attached to the body member 11. According to the foregoing construction, the electric motor 13, the worm 14, the worm wheel 15, the lock shaft 16, and the stopper member 18 can be retained without shakiness by the body member 11 and the cover 12.

Figure 9:
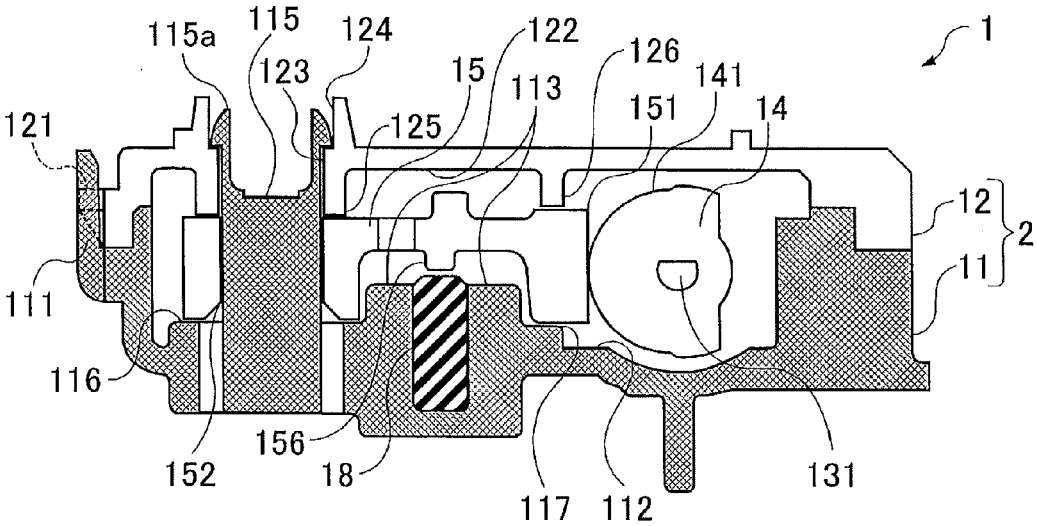
FIG. 9 is an explanatory cross-sectional view of the lid lock apparatus shown in FIG. 1 taken on line XI-XI for explaining a construction of the apparatus using tone differences of colors of members according to the first embodiment disclosed here.
Figure 10:
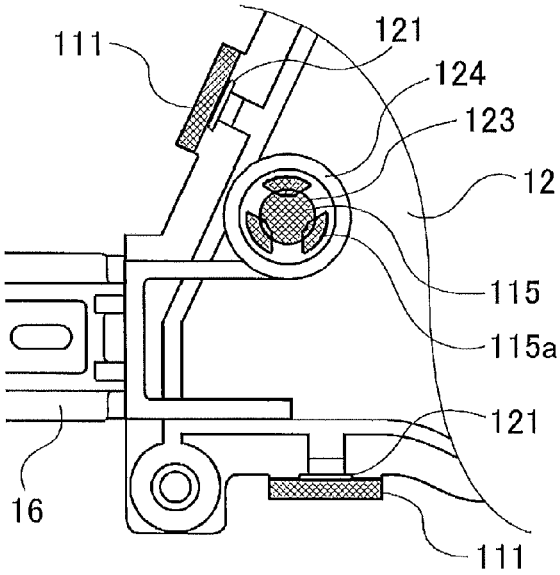
FIG. 10 is a partial front view of the lid lock apparatus shown in FIG. 1 for explaining a construction of the apparatus using tone differences of colors of members according to the first embodiment disclosed here.
Figure 11:
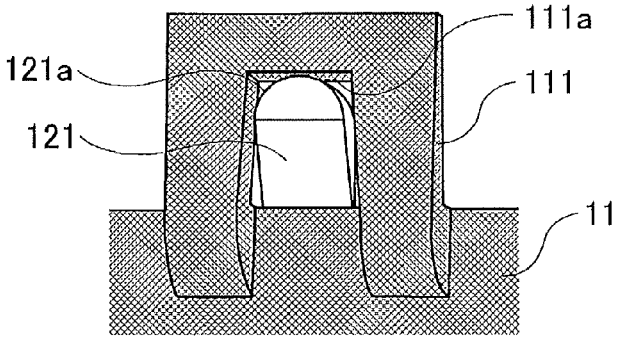
FIG. 11 is a partial side view for explaining an engaging state of an engaging piece and an engaging protrusion portion of the lid lock apparatus shown in FIG. 1 using tone differences of colors of members according to the first embodiment disclosed here.
Figure 12:
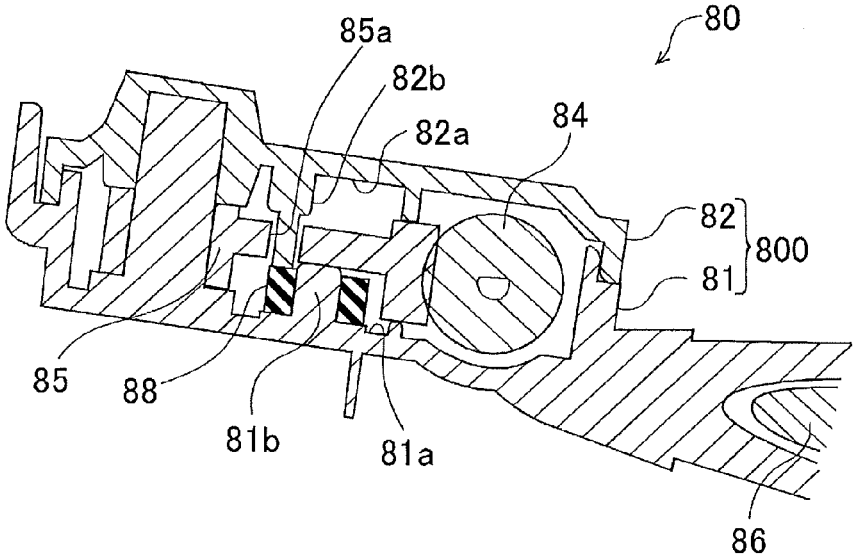
F I G. 12 Prior Art
FIG. 12 is a cross-sectional view of a known lid lock apparatus.

As shown in FIGS. 9 to 11, a color of the body member 11 is dark color, for example, black and a color of the cover 12 and the worm wheel 15 is light color, for example, white. Thus, as shown in FIGS. 10 and 11, a state of the hook 115*a* of the shaft member 115 engaged with the rim portion of the engagement hole 123 and a state of the engaging piece 111 engaged with the engaging protrusion portion 121 is readily recognized by the color tone differences (brightness differences of color). The engaging states of the hook 115*a* with the engagement hole 123 and of the engaging piece 111 with the engaging protrusion portion 121 can be visually confirmed, or checked by an operator who is in charge of assembling. Alternatively, the engaging states of the hook 115*a* with the engagement hole 123 and of the engaging piece 111 with the engaging protrusion portion 121 can be confirmed, or checked by a sensor which discerns color tone differences (i.e., differences in brightness of colors of members).

As shown in FIG. 11, a surface 121*a* to be engaged of the engaging protrusion portion 121 of the cover 12 is formed to have a round configuration (semi-arced shape) which is formed by chamfering corners of a rectangular configuration, whereas an engaging surface 111*a* of the engaging piece 111 of the body member 11 is formed to have a straight line, or to be flat. Accordingly, the surface 121*a* to be engaged of the engaging protrusion portion 121 is engaged with the engaging surface 111*a* of the engaging piece 111 of the body member 11 by means of a line contact.

In a case where the surface 121*a* to be engaged is formed in the rectangular configuration, because the engaging surface 111*a* and the surface 121*a* to be engaged contact via surfaces, a noise may be generated by a frictional contact between the surfaces. Further, in a case where a burr is formed at the engaging piece 111 and the engaging protrusion portion 121 or in a case where there is a defect in precision for forming the engaging piece 111 and the engaging protrusion portion 121, there is a possibility that a corner portion of the surface 121*a* to be engaged is caught at an inner surface of the engaging piece 111 which is formed in approximately U-shape to be a semi-fitted state unintentionally. Particularly, with the construction of the lid lock apparatus 1 including the body member 11 and the cover 12 which are less likely to be flexed because the size of the body member 11 and the cover 12 are smaller, the body member 11 and the cover 12 are likely to be the semi-fitted state unintentionally.

To the contrary, according to the construction of the embodiment, by forming the surface 121*a* to be engaged in a round configuration, a noise caused by the frictional contact between the surfaces of the engaging surface 111*a* and the surface 121*a* to be engaged is less likely generated by an amount of a reduced contact area between the engaging surface 111*a* and the surface 121*a* to be engaged. Further, because corner portions are not formed at the surface 121*a* to be engaged, the body member 11 and the cover 12 can be securely fitted to, or engaged with each other without a state where the surface 121*a* to be engaged is caught to the inner surface of the engaging piece 111 formed in the substantially U-shape.

As shown in FIGS. 3 to 5, the lid lock apparatus 1 is mounted to a support wall 311 of the lid box 31 via a retainer 33. The retainer 33, which is not a part of the lid lock apparatus 1, is attached to the support wall 311 penetrating therethrough. A sealing plate 34 is provided between the support wall 311 and a large diameter portion 331 of the retainer 33 which protrudes into the lid box 31 (i.e., forward direction of the support wall 311 in FIGS. 3 to 5) to liquid-tightly seal the lid box 31. As shown in FIG. 1, a waterproof ring 19 which is made from synthetic rubber material is attached to a seal groove 118*a* formed at a front end portion of the shaft retaining portion 118 of the body member 11. As shown in FIG. 3, the shaft retaining portion 118 of the lid lock apparatus 1 is inserted into the retainer 33 to be fixed to the support wall 311, and the water proof ring 19 is provided between the shaft retaining portion 118 and the retainer 33 to seal the shaft retaining portion 118 and the retainer 33.

As shown in FIG. 1, an operation lever 119 extends in a rearward direction from the shaft retaining portion 118 of the lid lock apparatus 1, and an engaging portion 119*a* is provided protruding from an intermediate portion of the operation lever 119. When inserting the shaft retaining portion 118 relative to the retainer 33 in a forward direction in FIG. 3, the engaging portion 119*a* comes to contact an internal peripheral surface of the retainer 33 so that the operation lever 119 is flexed upwardly in FIG. 3. By further inserting the shaft retaining portion 118 relative to the retainer 33, the operation lever 119 is restored and the engaging portion 119*a* comes to engage with a recessed portion 332 (see FIG. 3) of the retainer 33, thus preventing the disengagement of the shaft retaining portion 118.

Even when the lock shaft 16 axially moves relative to the housing 2 in a state where the shaft retaining portion 118 is mounted to the retainer 33, the lid lock apparatus 1 is prevented from being disengaged from the vehicle body 3 by the engagement of the engaging portion 119*a* with the recessed portion 332. Further, according to the construction of the embodiment explained above, the detachment of the lid lock apparatus 1 from the vehicle body 3 can be prevented completely when the lock shaft 16 is pulled towards the position at which the lock shaft 16 is disengaged from the lid member 32 (i.e., when the lock shaft 16 is pulled towards a disengaging direction from the lid member 32) by means of the emergency pull cord 17.

On the other hand, by a manual operation of the operation lever 119 by an operator, the operation lever 119 is biased upwardly in FIG. 3 for removing the lid lock apparatus 1 from the vehicle body 3. In those manners, the lid lock apparatus 1 can be readily removed from the vehicle body 3 by pulling the shaft retaining portion 118 from the retainer 33 in the rearward direction in FIG. 3 while disengaging the engaging portion 119*a* from the recessed portion 332.

As shown in FIG. 3, according to the construction of the lid lock apparatus 1, the electric motor 13 is actuated under a predetermined condition in a state where the lock shaft 16 is disengaged from the lid member 32 (i.e., an unlocked position). By the actuation of the electric motor 13, the worm wheel 15 rotates about the shaft member 115 via the worm 14 relative to the body member 11 in a counterclockwise direction in FIG. 3.

Accordingly, the lock shaft 16 which engages with the engaging column 153 of the worm wheel 15 at the interlock hole 163 moves in an axial direction (i.e., forward direction in FIG. 3) relative to the body member 11, and the lock portion 161 protrudes to the outside of the shaft retaining portion 118 of the body member 11 (i.e., a locked position) as shown in FIG. 4. In those circumstances, the lock portion 161 protrudes into the lid box 31 to engage with the lid member 32 to retain the lid member 32 so as not to open (see FIG. 5). FIG. 5 shows a front end portion of the lid lock apparatus 1 viewed from an upward direction in FIG. 4.

The rotation (pivotal movement) of the worm wheel 15 rotated by the worm 14 is stopped by a contact of the first stopper wall 154 to the protruding curved surface of one of the H-configuration portion of the stopper member 18 (i.e., the protruding curved surface provided at the lower position). In those circumstances, the stopper disengagement preventing portion 156 is positioned either contacting to or close to the end surface of the stopper member 18, the stopper member 18 does not lift up, or is not disengaged from the retaining portion 113. A controller connected to the electric motor 13 detects a load current of the electric motor 13 generated by the stoppage of the rotation of the worm wheel 15 and stops supplying the electric power to the electric motor 13.

As shown in FIG. 4, according to the construction of the lid lock apparatus 1, the electric motor 13 is operated under a predetermined condition in a state where the lock shaft 16 is positioned at the locked state to rotate the worm wheel 15 relative to the body member 11 in a reverse direction (i.e., in a clockwise direction in FIG. 4) reversal from the case where the lock shaft 16 is at the unlocked position. Thus, the lock shaft 16 is axially moved relative to the body member 11 (i.e., in the rearward direction in FIG. 4), and the lock portion 161 is stored within the shaft retaining portion 118 of the body member 11 (i.e., unlocked position). The retracted lock portion 161 is disengaged from the lid member 32 so that the lid member 32 is assumed to be openable.

The worm wheel 15 rotated in the reverse direction by the worm 14 is stopped by a contact of the second stopper wall 155 to the protruding curved surface of the other of the flanges of the H-configuration portion of the stopper member 18 (i.e., the protruding curved surface provided at the higher position). In those circumstances, because the stopper disengagement preventing portion 156 is positioned either contacting to or close to the end surface of the stopper member 18, the stopper member 18 does not lift up, or is not disengaged from the retaining portion 113. The controller connected to the electric motor 13 detects a load current of the electric motor 13 generated by the stoppage of the rotation of the worm wheel 15 and stops supplying the electric power to the electric motor 13.

According to the embodiment, the stopper member 18 is retained by the body member 11 and the stopper disengagement preventing portion 156 is formed at the worm wheel 15. When restricting the rotation (pivotal movement) of the worm wheel 15 by a contact of the stopper member 18 to the first stopper wall 154 and the second stopper wall 155, the stopper disengagement preventing portion 156 comes to contact the stopper member 18 in the axial direction (i.e., in the direction of the rotational axis) of the worm wheel 15 to restrict the disengagement of the stopper member 18 from the retaining portion 113 (i.e., the disengagement of the stopper member 18 from the retaining portion 113 in the direction of the rotational axis of the worm wheel 15).

Namely, when the stopper member 18 moves upward relative to the retaining portion 113, the stopper disengagement preventing portion 156 comes to contact the stopper member 18 to block the further movement in the upward direction. Accordingly, the disengagement of the stopper member 18 from the retaining portion 113 can be prevented without a construction which declines the rigidity of the worm wheel 15, for example, because of machining a hole or slit formed on the worm wheel.

The arc shaped rib which extends from the first stopper wall 154 to the second stopper wall 155 serves as the stopper disengagement preventing portion 156. Thus, by reinforcing the worm wheel 15 with the stopper disengagement preventing portion 156 which is formed with the arc shaped rib, the rigidity of the worm wheel 15 is enhanced.

According to the embodiment, the shaft member 115 formed on the body member 11 as the rotational axis of the worm wheel 15 and the engagement hole 123 formed on the cover 12 are engaged by means of a snap-fit construction. Thus, the cover 12 can be securely engaged with the body member 11 with a simple construction.

According to the embodiment, by a contact of the first output gear disengagement preventing portion 125 and the second output gear disengagement preventing portion 126 which are formed on the inner surface 122 of the cover 12 to the worm wheel 15 in the direction of the rotational axis of the worm wheel 15, the disengagement of the worm wheel 15 from the shaft member 115 is restricted. According to the foregoing construction, because the stopper disengagement preventing portion 156 securely comes to contact the stopper member 18 without the displacement of the position of the worm wheel 15 relative to the body member 11, the disengagement of the stopper member 18 from the retaining portion 113 can be securely restricted.

In those circumstances, the first output gear disengagement preventing portion 125 is in contact with or positioned close to the portion of the worm wheel 15 in the vicinity of the pivot hole 152, and the second output gear disengagement preventing portion 126 is in contact with or positioned close to the portion of the worm wheel 15 in the vicinity of the outer peripheral surface 151. Thus, because the first output gear disengagement preventing portion 125 and the second output gear disengagement preventing portion 126 come to contact with the worm wheel 15 at the plural portions (e.g., two portions) which are away from each other as much as possible, a large degree of a distance between the contact points of the worm wheel 15 with the first output gear disengagement preventing portion 125 and with the second output gear disengagement preventing portion 126, respectively, (i.e., a distances between supporting points) is ensured, and thus the unintentional movement in an undesired direction is unlikely caused during the rotation of the worm wheel 15.

According to the embodiment, the color of the body member 11 is black, which is a dark color, and the color of the cover 12 and the worm wheel 15 is white, which is a light color. With the foregoing construction, a state of the hook 115*a* of the shaft member 115 being engaged with the rim portion of the engagement hole 123 and a state of the engaging piece 111 being engaged with the engaging protrusion portion 121 are readily recognized by the tone differences in colors of the members. Thus, the body member 11 and the cover 12 can be securely assembled.

Constructions of the lid lock apparatus 1 according to the disclosure is not limited to the embodiment described above, and may be varied within a range not departing from the scope of the disclosure.

For example, according to the construction of the embodiment described above, the stopper disengagement preventing portion 156 includes the rib formed in an arc shape and having the constant height to be constantly in contact with the end surface of the stopper member 18 during the rotation of the worm wheel 15 or to be constantly positioned close to the end surface of the stopper member 18. However, the stopper member 18 moves upwardly relative to the retaining portion 113 only when the stopper member 18 contacts the first stopper wall 154 and the second stopper wall 155. Thus, a height of the protrusion of the stopper disengagement preventing portion may be formed to be higher only at both ends in the pivotal direction of the worm wheel 15 so that the stopper disengagement preventing portion does not contact or is not assumed to be close to the stopper member 18 during the rotation (pivotal movement) of the worm wheel 15.

Namely, alternatively, the stopper disengagement preventing portion 156 may be formed to have an arc shaped rib having various heights of protrusion in the pivotal direction of the worm wheel 15, that is, the stopper disengagement preventing portion 156 may be formed to have a lower height at an intermediate portion of the arc shaped rib compared to the height of the end portions of the arch shaped rib. Further, alternatively, a height of the protrusion of the intermediate portion of the arc shaped stopper disengagement preventing portion 156 may be zero and two separate stopper disengagement preventing portions may be formed each at a position adjacent to the first stopper wall 154 and a position adjacent to the second stopper wall 155.

According to the embodiment, the rib protruding in a rectangular shape in cross-section is applied as the stopper disengagement preventing portion 156, however, alternatively, the stopper disengagement preventing portion may be formed as a protruding portion having a semi-circular configuration in cross-section.

According to the embodiment, the stopper member 18 is retained at the body member 11, and the first stopper wall 154, the second stopper wall 155, and the stopper disengagement preventing portion 156 are formed at the worm wheel 15. Alternatively, the worm wheel 15 may be retained at the stopper member 18, and the first stopper wall, the second stopper wall, and the stopper disengagement preventing portion may be formed on the body member 11.

Further, according to the embodiment, the body member 11 is formed in the dark color, for example, black, and the cover 12 and the worm wheel 15 are formed in the light color, for example, white. However, alternatively, the body member 11 may be formed in a light color, and the cover 12 and the worm wheel 15 may be formed in a dark color. In those circumstances, colors having degrees of brightness whose differences are readily recognizable may be applied as the light color and the dark color. For example, light pink or yellow other than white may be applied as the light color and dark green or dark brown other than black may be applied as the dark color.

According to the embodiment, the lid lock apparatus 1 is mounted to the support wall 311 of the lid box 31 via the retainer 33 which is a separate member from the support wall 311 of the lid box 31. In those circumstances, alternatively, the retainer 33 and the support wall 311 may be integrally joined by means of, for example, bonding or welding. Further, alternatively, the retainer and the support wall may be integrally formed by resin. In a case where the retainer and the support wall are integrally formed, the sealing plate 34 is not required and the lid box 31 is liquid-tightly sealed by the water-proof ring 19.

According to the construction of the embodiment, the lid lock apparatus (1) includes the housing (2) formed by assembling the first body member (the body member 11) and the second body member (the cover 12), the driving motor (electric motor 13) housed in the housing (2), the output gear (worm wheel 15) pivotally supported within the housing and being rotatable in a first direction and a second direction by an actuation of the driving motor (electric motor 13), the movable member (lock shaft 16) movably supported in the housing (2), the movable member (lock shaft 16) moving in one direction by a pivotal movement of the output gear (worm wheel 15) in the first direction to make the lid member (32) provided at a vehicle body be unopenable and moving in the other direction by the pivotal movement of the output gear (worm wheel 15) in the other direction to make the lid member (32) to be openable, the stopper member (18) retained at one of the first body member (body member 11) and the output gear (worm wheel 15), the stopper wall (154, 155) formed at the other one of the first body member (body member 11) and the output gear (worm wheel 15) and restricting the pivotal movement of the output gear (worm wheel 15) by contacting the stopper member (18), and the stopper disengagement preventing portion (156) formed on the mentioned the other one of the first body member (body member 11) and the output gear (worm wheel 15), on which the stopper wall (154, 155) is formed, to be close to the stopper wall (154, 155). The stopper disengagement preventing portion (156) is configured to restrict a disengagement of the stopper member (18) in an axial direction of a rotational axis of the output gear (worm wheel 15) by contacting the stopper member (18) in the axial direction of the rotational axis of the output gear (worm wheel 15).

According to the construction of the embodiment, the stopper member 18 is retained at either one of the first body member (the body member) 11 and the output gear (the worm wheel) 15 and the stopper disengagement preventing portion 156 is formed at the other of the first body member (the body member) 11 and the output gear (the worm wheel) 15. When the rotation (pivotal movement) of the output gear (the worm wheel) 15 is restricted by the contact of the stopper member 18 and the stopper wall (the first stopper wall, the second stopper wall) 154, 155, the disengagement of the stopper member 18 in the direction of the rotational axis of the output gear (the worm wheel) 15 is restricted by a contact of the stopper disengagement preventing portion 156 to the stopper member 18 in the axial direction of the rotational axis of the output gear (the worm wheel 15). That is, when the stopper member 18 apt to move upward in the axial direction of the rotational axis of the output gear (the worm wheel) 15, the stopper disengagement preventing portion 156 which comes in contact with or which is in contact with the stopper member 18 blocks the upward movement of the output gear (the worm wheel) 15. Thus, the disengagement of the stopper member 18 in the axial direction of the rotational axis of the output gear (the worm wheel 15) can be prevented without providing a construction which declines the rigidity of the output gear (the worm wheel) 15, for example, because of machining a hole or slit on the output gear (the worm wheel) 15.

According to the construction of the embodiment of the lid lock apparatus 1, the stopper member (18) is retained at the first body member (body member 11), the stopper wall (154, 155) is formed at the output gear (the worm gear 15) and includes the first stopper wall (154) and the second stopper wall (155) positioned keeping a distance from each other in a pivotal direction of the output gear (the worm gear 15). The stopper disengagement preventing portion (156) is formed on the output gear (the worm gear 15) and includes an arc-shaped protruding portion extending from the first stopper wall (154) to the second stopper wall (155), and the stopper disengagement preventing portion (156) is configured to contact the stopper member (18) when the stopper member (18) comes to contact with the first stopper wall (154) and the second stopper wall (155).

According to the construction of the embodiment, the stopper member 18 is retained at the first body member (body member) 11 and the stopper wall 154, 155 and the stopper disengagement preventing portion 156 are formed on the output gear (the worm wheel) 15. The stopper wall 154, 155 includes the first stopper wall 154 and the second stopper wall 155 which are arranged keeping a distance in a pivotal direction (rotational direction) of the output gear (the worm wheel) 15. The stopper disengagement preventing portion includes the arc shaped protruding portion ranging from the first stopper wall 154 to the second stopper wall 155. Thus, by reinforcing the output gear (the worm wheel) 15 by the stopper disengagement preventing portion 156 which includes the arc shaped protruding portion, the disengagement of the stopper member 18 in the axial direction of the rotational axis of the output gear (the worm wheel) 15 can be prevented while enhancing the rigidity of the output gear (the worm wheel) 15.

According to the embodiment, the lid lock apparatus further includes the shaft member (115) formed on the first body member (body member 11), serving as the rotational axis of the output gear (worm wheel 15), and formed with a hook (115*a*) at a tip end thereof, the engagement hole (123) formed on the second body member (cover 12) for engaging with the hook (115*a*) of the shaft member (115) by a snap-fit structure for engaging the second body member (cover 12) to the first body member (body member 11), and the output gear disengagement preventing portion (first and second output gear disengagement preventing portion 125, 126) formed on the second body member (cover 12) for restricting the disengagement of the output gear (worm wheel 15) from the shaft member (115) by contacting the output gear (worm wheel 15) in the axial direction of the rotational axis of the output gear (worm wheel 15).

According to the construction of the embodiment, the shaft member 115 serving as the rotational axis of the output gear (the worm wheel) 15 and formed on the first body member (body member) 11 and the engagement hole 123 formed on the second body member (cover) 12 are engaged by the snap-fit construction. According to this construction, the second body member (cover) 12 can be securely engaged with the first body member (body member) 11 with a simple structure. Further, the disengagement of the output gear (worm wheel) 15 from the shaft member 115 is restricted by a contact of the output gear disengagement preventing portion 125, 126 formed on the second body member (cover) 12 to the output gear (the worm wheel) 15 in the axial direction of the rotational axis of the output gear (the worm wheel) 15. According to the foregoing construction, because the disengagement of the output gear (worm wheel) 15 is restricted by the output gear disengagement preventing portion 125, 126, the position of the output gear (worm wheel 15) relative to the first body member (body member) 11 is not deviated, or does not slip out of the predetermined position, the stopper disengagement preventing portion 156 securely comes in contact with or in contact with the stopper member 18, and the disengagement of the stopper member 18 in the axial direction of the rotational shaft of the output gear (the worm wheel) 15 can be securely restricted.

According to the embodiment of the lid lock apparatus 1, the output gear disengagement preventing portion (125, 126) is configured to contact the output gear (worm wheel 15) at least at two portions, at a portion of the output gear (worm wheel 15) in the vicinity of the rotational axis of the output gear (worm wheel 15) and at a portion of the output gear (worm wheel 15) in the vicinity of an outer peripheral surface of the output gear (worm wheel 15).

According to the construction of the embodiment, the output gear disengagement preventing portion 125, 126 comes in contact with or in contact with the output gear (the worm wheel 15) at least two positions, that is, at the portion of the output gear (the worm wheel) 15 in the vicinity of the rotational axis and the portion of the output gear (the worm wheel) 15 in the vicinity of the outer peripheral surface. According to the construction in which the output gear disengagement preventing portion 125, 126 contacts the output gear (the worm wheel) 15 at the portions which are away from each other to the maximally allowable level, an unintentional movement in an undesired direction is unlikely generated during the rotation (pivotal movement) of the output gear (the worm wheel) 15 by a degree of a distance between contact points (i.e., a distance between supporting points).

According to the embodiment of the lid lock apparatus 1, one of the first body member (11) on which the shaft member (115) is formed and the second body member (12) on which the engagement hole (123) is formed is made from a member colored in a light color and the other one of the first body member (11) and the second body member (12) is made from a member colored in a dark color.

According to the construction of the embodiment, one of the first body member (body member) 11 to which the shaft member 115 is formed and the second body member (the cover) 12 on which the engagement hole 123 is formed is formed with a member with light color, and the other of the first body member (body member) 11 and the second body member (the cover) 12 is formed with a member with dark color. According to the foregoing construction, a state of the hook 115*a* of the shaft member 115 being engaged with the rim portion of the engagement hole 123 is assumed to be readily recognizable by the tone differences of the color of the members. Thus, the second body member (the cover) 12 can be securely engaged with the first body member (body member) 11. For example, white, light pink, and yellow may be applied as the light color, and black, dark green, and dark brown may be applied as the dark color. The engaging state may be visually checked by a person in charge of assembling, or may be checked by a sensor which discerns color tone differences (i.e., differences in brightness of colors of members) by the judgment on the basis of images.

According to the construction of the embodiment, the lid lock apparatus 1 which prevents the stopper member 18 for restricting the rotation of the output gear (the worm wheel) 15 being disengaged in the axial direction of the rotational axis of the output gear (the worm wheel) 15 is attained without declining the rigidity of the output gear, for example, a worm wheel.

According to the embodiment of the lid lock apparatus 1, the first body member (body member) 11 and the second body member (cover) 12 are assembled by a fitting engagement.

According to the embodiment of the lid lock apparatus 1, the fitting engagement corresponds to a snap fit.

According to the embodiment of the lid lock apparatus 1, the stopper disengagement preventing portion (156) corresponds to a rib which protrudes in a rectangular configuration in cross-section.

According to the embodiment of the lid lock apparatus 1, a protruding length of the protruding portion of the stopper disengagement preventing portion (156) is constant in a range from the first stopper wall (154) to the second stopper wall (155).

According to the embodiment of the lid lock apparatus 1, the light color is one of white, light pink, and yellow.

According to the embodiment of the lid lock apparatus 1, the dark color is one of black, dark green, and dark brown.

According to the embodiment of the lid lock apparatus 1, the first body member (body member 11) on which the shaft member (115) is formed and the second body member (cover 12) on which the engagement hole (123) is formed are made from members colored in different colors having brightness differences which are readily discernible from each other.

According to the embodiment of the lid lock apparatus 1, the first body member (body member 11) on which the shaft member (115) is formed and the second body member (cover 12) on which the engagement hole (123) is formed are made from members colored in different colors having brightness differences which are readily discernible by a sensor.

According to the embodiment of the lid lock apparatus 1, the output gear corresponds to a sector gear which is made of resin.

According to the embodiment of the lid lock apparatus 1, the resin made sector gear is geared with the worm (14) which integrally rotates with the driving motor (13).

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

The invention claimed is:

1. A lid lock apparatus, comprising:

a housing formed by assembling a first body member and a second body member;

a driving motor housed in the housing;

an output gear pivotally supported within the housing and being rotatable in a first direction and a second direction by an actuation of the driving motor;

a movable member movably supported in the housing, the movable member moving in one direction by a pivotal movement of the output gear in the first direction to make a lid member provided at a vehicle body be unopenable and moving in the other direction by the pivotal movement of the output gear in the other direction to make the lid member to be openable;

a stopper member retained at one of the first body member and the output gear;

a stopper wall formed at the other one of the first body member and the output gear and restricting the pivotal movement of the output gear by contacting the stopper member;

a stopper disengagement preventing portion formed on said the other one of the first body member and the output gear, on which the stopper wall is formed, to be close to the stopper wall, the stopper disengagement preventing portion restricting a disengagement of the stopper member in an axial direction of a rotational axis of the output gear by contacting the stopper member in the axial direction of the rotational axis of the output gear;

a shaft member formed on the first body member, serving as the rotational axis of the output gear, and formed with a hook at a tip end thereof;

an engagement hole formed on the second body member for engaging with the hook of the shaft member by a snap-fit structure for engaging the second body member to the first body member; and an output gear disengagement preventing portion formed on the second body member for restricting the disengagement of the output gear from the shaft member by contacting the output gear in the axial direction of the rotational axis of the output gear.

2. The lid lock apparatus according to claim 1, wherein the stopper member is retained at the first body member;

the stopper wall is formed at the output gear and includes a first stopper wall and a second stopper wall positioned keeping a distance from each other in a pivotal direction of the output gear;

the stopper disengagement preventing portion is formed on the output gear and includes an arc-shaped protruding portion extending from the first stopper wall to the second stopper wall, and the stopper disengagement preventing portion is configured to contact the stopper member when the stopper member comes to contact with the first stopper wall and the second stopper wall.

3. The lid lock apparatus according to claim 1, wherein the output gear disengagement preventing portion is configured to contact the output gear at least at two portions, at a portion of the output gear in the vicinity of the rotational axis of the output gear and at a portion of the output gear in the vicinity of an outer peripheral surface of the output gear.

4. The lid lock apparatus according to claim 1, wherein one of the first body member on which the shaft member is formed and the second body member on which the engagement hole is formed is made from a member colored in a light color and the other one of the first body member and the second body member is made from a member colored in a dark color.

5. The lid lock apparatus according to claim 1, wherein the first body member and the second body member are assembled by a fitting engagement.

6. The lid lock apparatus according to claim 5, wherein the fitting engagement corresponds to a snap fit.

7. The lid lock apparatus according to claim 1, wherein the stopper disengagement preventing portion corresponds to a rib which protrudes in a rectangular configuration in cross-section.

8. The lid lock apparatus according to claim 2, wherein a protruding length of the protruding portion of the stopper disengagement preventing portion is constant in a range from the first stopper wall to the second stopper wall.

9. The lid lock apparatus according to claim 4, wherein the light color is one of white, light pink, and yellow.

10. The lid lock apparatus according to claim 4, wherein the dark color is one of black, dark green, and dark brown.

11. The lid lock apparatus according to claim 1, wherein the first body member on which the shaft member is formed and the second body member on which the engagement hole is formed are made from members colored in different colors having brightness differences which are readily discernible from each other.

12. The lid lock apparatus according to claim 1, wherein the first body member on which the shaft member is formed and the second body member on which the engagement hole is formed are made from members colored in different colors having brightness differences which are readily discernible by a sensor.

13. The lid lock apparatus according to claim 1, wherein the output gear corresponds to a sector gear which is made of resin.

14. The lid lock apparatus according to claim 13, wherein the resin made sector gear is geared with a worm which integrally rotates with the driving motor.

15. The lid lock apparatus according to claim 1, further comprising:

a boss formed protruding upwardly from an outer surface of the second body member;

the boss surrounding a portion of the engagement hole; and the boss preventing the hook from contacting surrounding components.

16. The lid lock apparatus according to claim 1, wherein the hook restricts disengagement of the shaft member and the engagement hole.

17. The lid lock apparatus according to claim 1, wherein a part of the engagement hole is surrounded by a wall protruding away from an inner surface of the second body member.

18. A lid lock apparatus, comprising:

a housing formed by assembling a first body member and a second body member;

a driving motor housed in the housing;

an output gear pivotally supported within the housing and being rotatable in a first direction and a second direction by an actuation of the driving motor;

a movable member movably supported in the housing, the movable member moving in one direction by a pivotal movement of the output gear in the first direction to make a lid member provided at a vehicle body be unopenable and moving in the other direction by the pivotal movement of the output gear in the other direction to make the lid member to be openable;

a stopper member retained at one of the first body member and the output gear;

a stopper wall formed at the other one of the first body member and the output gear and restricting the pivotal movement of the output gear by contacting the stopper member;

a stopper disengagement preventing portion formed on said the other one of the first body member and the output gear, on which the stopper wall is formed, to be close to the stopper wall, the stopper disengagement preventing portion restricting a disengagement of the stopper member in an axial direction of a rotational axis of the output gear by contacting the stopper member in the axial direction of the rotational axis of the output gear;

a shaft member extending from the first body member, the shaft member having a tip end;

an engagement hole formed on the second body member;

a portion of the shaft member being inside the engagement hole, and an engaging portion of the tip end of the shaft member being positioned outside the engagement hole;

wherein the outer dimension of the engaging portion of the tip end of the shaft member which is positioned outside the engagement hole is larger than the inner dimension of the engagement hole.

* * * * *